United States Patent [19]

Cich

[11] Patent Number: 5,000,317

[45] Date of Patent: Mar. 19, 1991

[54] SPORTS GLOVE STORAGE BALL

[76] Inventor: Joel A. Cich, 1010 Mulberry St., Mankato, Minn. 56001

[21] Appl. No.: 498,705

[22] Filed: Mar. 26, 1990

[51] Int. Cl.[5] ..... B65D 85/18

[52] U.S. Cl. ..... 206/315.1; 2/19; 206/278; 206/315.9; 223/78

[58] Field of Search ..... 2/19, 160; 206/278, 206/315.1, 315.9; 220/4.25; 273/25, 148 R; 223/78–80, 84

[56] References Cited

U.S. PATENT DOCUMENTS

| | | | |
|---|---|---|---|
| 3,843,126 | 10/1974 | Bandy | 2/19 |
| 4,418,849 | 12/1983 | Santa | 223/78 |
| 4,691,824 | 9/1987 | Schindler | 206/315.9 |
| 4,765,519 | 8/1988 | Groves | 223/78 |
| 4,877,162 | 10/1989 | McGinley | 223/78 |
| 4,883,170 | 11/1989 | Wright | 206/315.1 |

*Primary Examiner*—Jimmy G. Foster

[57] ABSTRACT

A hollow, plastic sphere comprised of two equal halves fitted together with a strap protruding from within the hollow sphere. The sphere opens to allow storage of a baseball or softball and is placed into the pocket of a baseball or softball glove. The strap protruding from within the sphere is extended around the glove and tightened, snugly fitting the sphere in the pocket of the glove. The hollow sphere is strapped into the glove between uses of the glove to help protect and form the glove's pocket and allow for convenient storage of a baseball or softball.

4 Claims, 1 Drawing Sheet

SPORTS GLOVE STORAGE BALL

BACKGROUND OF THE INVENTION

1. Field of the Invention

This invention relates in general to softball and baseball. More specifically, this invention relates to a preferable and proper way of forming and protecting the pocket of a baseball or softball glove during the off-season and between uses during the season; and a convenient way to store a softball or baseball during the off-season and between uses of the baseball or softball glove during the season.

2. Prior Art

Creating a pocket in a softball or baseball glove helps players field balls and makes the glove more comfortable. Better fielding enhances the player's ability to play and fewer errors or missed balls makes the game of softball or baseball safer to play. This invention will also help protect the baseball or softball glove when not in use. When a glove is stored, or during travel, the glove is often flattened out and the user must re-form the pocket. Often, softball and baseball players will stuff clothes or other materials into their gloves to protect the pocket because no other alternative exists. Simply putting a softball or baseball into a glove when the glove is not in use will not help form a pocket because softballs and baseballs are not large enough and will easily roll out of the glove. But because so many players do like to keep their ball with their glove, this invention allows the player to continue this practice.

SUMMARY OF THE INVENTION

The principal object of the invention is to provide a device which helps create a better pocket for a baseball or softball glove and protect the glove's pocket when the glove is not in use.

It is also an object of the invention to provide a device for convenient storage of a baseball or softball within the softball or baseball glove.

It is also an object of the invention to provide a device which is of simple, inexpensive construction.

The foregoing objects can be accomplished by creating a round, hollow plastic ball preferably 5½ inches in diameter, consisting of two equal halves fitted together at their equator. Each of the halves will be notched along a portion of their outer rim so that when the halves are fitted together the notches will create a single slit. A strap, 2 inches wide and approximately 30 inches long will go through the slit into the hollow sphere, around a bar, or brace, located within the hollow sphere and back out again, leaving both ends of the strap protruding from within the hollow sphere. At one end of the strap protruding from within the hollow sphere there is a buckle, the other end of the strap protruding from within the hollow sphere will extend around the baseball or softball glove back to the buckle, then be looped through the buckle and be tightened, so that the glove will have a snug fit around the hollow sphere located within the glove's pocket.

DETAILED DESCRIPTION OF THE DRAWING

Figure 1:
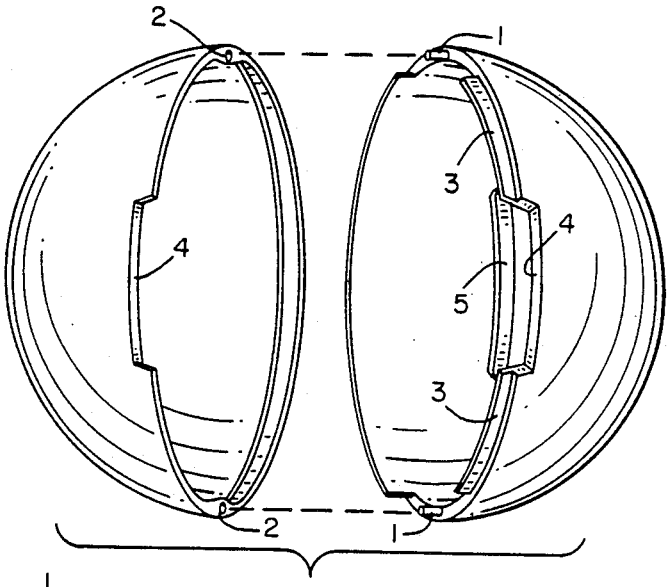
FIG. 1 is a perspective of the two separated halves of the sports glove storage ball.

FIG. 1 shows that part of the invention consisting of two equal and symmetrical halves made of strong, weather-protective plastic. The halves are to be connected at the equator of the hollow sphere which is formed by fitting the two halves together. Preferably, the size of the resulting sphere will be 5½ inches in diameter.

As shown in FIG. 1, located on the outer rim, or equator, of one of the two halves are two plastic pins(1) which protrude from directly underneath the outer rim. The two pins are equadistant from one another, or at opposite ends of the equator. When the two halves are fitted together, the pins(1) will extend into and fit snugly into small holes(2) located directly underneath the outer rim of the other of the two halves. The holes are equadistant from one another, or at the opposite ends of the equator.

Also located along the outer rim of the half with the pins is a lip(3) protruding from underneath the outer rim allowing the two halves to fit together more snugly and firmly.

As further shown in FIG. 1, each of the two halves are cut, or notched along their outer rim(4). The cut of each half will be 2¼ inches in length (along the equator) and three-twentieth's inch in depth. The two halves, when fitted together to create a hollow sphere will be fitted together such that the cuts form a single slit 2¼ inches in length and three tenth's of an inch in width.

Figure 2:
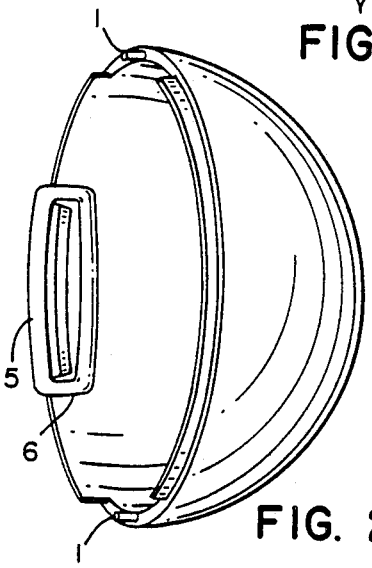
FIG. 2 is a perspective of the half of the sports glove storage ball containing the inner plastic brace of which the strap is looped around.

The purpose of the slit is to allow an opening from the outside of the sphere to the hollow inside of the sphere. As best seen in FIG. 2, located underneath the slit there is positioned a plastic bar(5), said bar being part of a plastic brace(6) glued or molded to the underside of one of the two halves of the plastic sphere. The center of the bar(5) runs lengthwise with the equator of the sphere. The width of the bar is narrower than the width of the slit, thus allowing a strap to be inserted and pass through the space between the bar and slit on both sides of the bar. The brace(6) is fitted to one of the halves so that the half of the sphere without the brace attached will fit over the brace and connect to the other half of the sphere.

Figure 3:
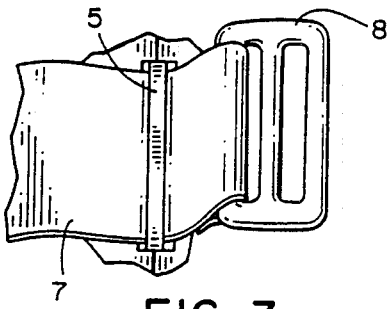
FIG. 3 is a top perspective of the buckle attached to one end of the strap, with the strap going into the slit of the hollow sphere, under the brace located within the hollow sphere, and out again.
Figure 4:
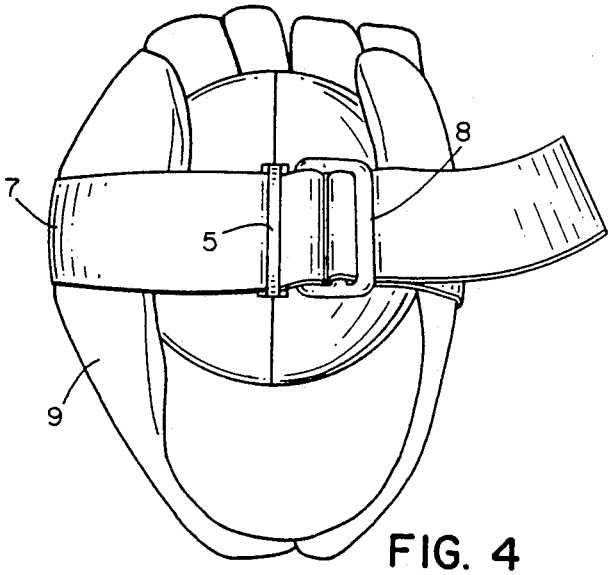
FIG. 4 is a top perspective of the sports glove storage ball being used in accordance with the present invention.

As best shown in FIG. 3, the 2 inch wide, webbed nylon strap(7) is looped underneath the bar(5). Attached to one end of the strap is a buckle(8), which, during use, will remain near the slit. The width of the buckle will prevent the strap from being pulled into the hollow sphere. As best shown in FIG. 4, the other end of the strap will extend around the glove(9), back to the buckle(8). This end of the strap then loops through the buckle and the strap is tightened by pulling the strap through the buckle.

Figure 5:
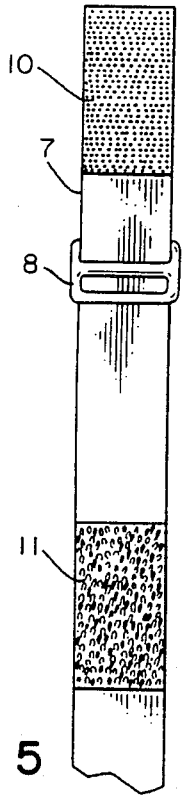
FIG. 5 is a top perspective of the strap and buckle showing the location of the Velcro strips in relation to the buckle.

When the strap is extended around the glove and looped through the buckle, there will preferably remain approximately 6 inches of excess strap for the user to grasp to pull the strap for a tight fit. As best shown in FIG. 5, the surface of the excess strap that faces the glove after being looped through the buckle will carry a plurality of small hook-like members(10) in position to engage a felt-like material(11) carried by the facing surface of the strap(7) also as shown in FIG. 5. A conventional type fastening device embodying such hook-like members(10) and felt-like material(11) is sold under the trade name "VELCRO". The purpose of the VELCRO is to lessen the chance that the strap will slip or loosen after the strap has been fitted snugly around the glove.

I claim:

1. A glove and ball storage device which comprises two equal halves made of strong, weather-protective plastic connected together resulting in a hollow sphere approximately 5½ inches in diameter with a belt protruding through a slit from within the hollow sphere said belt to be wrapped around the baseball or softball glove and tightened, thus securely fitting said hollow sphere within the pocket of the baseball or softball glove.

2. A glove and ball storage device as recited in claim 1 which comprises a means for protecting the pocket of a baseball or softball glove.

3. A glove and ball storage device as recited in claim 2 which comprises a means for helping form the pocket of a baseball or softball glove.

4. A glove and ball storage device as recited in claim 3 which comprises a means for storage of a baseball or softball within the pocket of a baseball or softball glove.

* * * * *